United States Patent [19]

David et al.

[11] 4,304,811

[45] Dec. 8, 1981

[54] HEAT RESISTANT-WEAR RESISTANT INDUSTRIAL TEXTILE FABRIC

[75] Inventors: Frederick R. David, Warminster; Harvey J. Goldberg, Fort Washington, both of Pa.

[73] Assignee: Narricot Industries, Inc., Philadelphia, Pa.

[21] Appl. No.: 203,632

[22] Filed: Nov. 3, 1980

[51] Int. Cl.[3] ..... D03D 3/00

[52] U.S. Cl. ..... 428/225; 57/238; 57/240; 428/229; 428/245; 428/260; 428/902

[58] Field of Search ..... 428/225, 227, 229, 245, 428/251, 252, 260, 902; 57/238, 240

[56] References Cited

U.S. PATENT DOCUMENTS

| | | | |
|---|---|---|---|
| 4,143,197 | 3/1979 | Jasionowicz et al. | 428/225 |
| 4,228,207 | 10/1980 | Porte et al. | 428/902 |
| 4,244,994 | 1/1981 | Tramor et al. | 428/227 |
| 4,246,313 | 1/1981 | Stengle | 428/920 |
| 4,255,817 | 3/1981 | Heim | 428/920 |

*Primary Examiner*—James J. Bell

*Attorney, Agent, or Firm*—Paul & Paul

[57] ABSTRACT

A woven fabric is described which is capable of resisting temperatures above 1000° F. without significant loss of strength and which is a functional replacement for similar fabrics manufactured from asbestos. The fabric is woven with a plied yarn in which one ply is a spun yarn comprising spun aramide fibers and the other ply is a continuous glass filament yarn. The relative amounts of aramide ply and glass filament ply making up the total yarn may be varied, however a preferred yarn comprises a minor amount of aramide ply and a major amount of glass filament ply. A most preferred yarn comprises 35 percent aramide ply and 65 percent glass filament ply.

4 Claims, No Drawings

HEAT RESISTANT-WEAR RESISTANT INDUSTRIAL TEXTILE FABRIC

BRIEF SUMMARY OF THE INVENTION

It is well known that safety requirements require the removal of asbestos and asbestos products from industrial environments. Because of its heat resistant properties, asbestos has heretofore been the customarily used material of fabrication for products designed to resist the temperatures experienced in the handling and conveying of materials in the manufacture of glass products. The extreme temperature range normally is from about 1000° F. to about 1400° F. In many prior asbestos applications, a heat resistant material must be provided in the form of a fabric, such as for example (1) tractor pads, continuous belts, roller guide covers, reject belts and back stops in glass tube draw apparatus, (2) rotary scoop liners, divider covers, lehr loader conveyor belts in glass ribbon machines, (3) conveyor belts and cooling towers for glass pressware and (4) push pads which prevent checking and damage to the glass products.

It has unexpectedly been discovered that fabric constructed of yarns comprising (1) a ply constituting a minor amount of the fabric yarn and composed of aramide fiber and (2) a ply constituting a major amount of the fabric yarn and composed of glass filaments which fabric is a satisfactory replacement for asbestos fabric in heat resistant applications.

Yarns and fabrics constructed from continuous glass fibers are known and are known to have excellent heat resistant properties because of their inorganic nature. However, being composed entirely of glass introduces limitations on the uses of such products because of brittleness and the accompanying modulus of elasticity.

In certain heat resistant applications, yarns and fabrics constructed from aramide fibers have been found acceptable and such products have increased wearing ability and are more elastic than comparable materials manufactured from glass fibers. Increasing temperatures, however, are known to decrease the tensile properties of aramide fibers, and such fibers begin to char at temperatures between 800° F. and 900° F.

When a yarn ply composed of spun aramide fibers is plied with a yarn ply composed of continuous glass fibers, a composite yarn is formed which may be readily fabricated into textile materials having such superior thermal resistance and long life as to constitue an excellent replacement for comparable asbestos products.

DETAILED DESCRIPTION OF THE INVENTION

EXAMPLE 1

A heat resistant fabric is prepared as follows: A single strand of 4/2's (cotton count) spun aramide fiber is twisted together with a single strand of 6.75 ETG textured glass filaments to form a plied yarn. A one-quarter inch thick, three inch wide fabric is formed from this yarn by weaving as follows:

| | |
|---|---|
| Warp Ends- | |
| Ground system | 266 ends |
| Binder system | 32 ends |
| Filling yarns | 14 per inch |

In the finished fabric the aramide fiber constitutes 35 percent by weight of the yarn and the glass filaments constitute 65 percent by weight of the yarn.

This fabric sustains repeated contact with materials having temperatures of up to 1400° F. without melting, burning or losing its textile properties.

Fabrics made in accordance with the construction of this invention are suitably formed into continuous conveyor belting and have withstood daily exposure to contact operating temperatures in glass container production of from 1200°–1400° F. while exhibiting good resistance up to 60 days to wear and abrasion. This constitutes a satisfactory replacement for a comparable asbestos fabric.

The fabrics of this invention may suitably be impregnated with resin emulsions in order to enhance such properties as abrasion and hand.

Having thus described our invention we claim:

1. A fabric resistant to high temperatures comprising a woven construction of a plied yarn consisting essentially of one ply of a yarn comprising spun aramide fibers and the other ply of a yarn comprising continuous glass filaments.

2. The fabric according to claim 1 wherein said spun aramide fiber ply constitutes a minor amount of the yarn weight and the continuous glass filament ply constitutes a major amount of the yarn weight.

3. The fabric according to claim 2 wherein the minor amount is 35 percent and the major amount is 65 percent.

4. A fabric according to claim 1 which is impregnated with a resin emulsion.

* * * * *